United States Patent [19]

Fischer

[11] 4,406,767

[45] Sep. 27, 1983

[54] ANODE HOODING SYSTEM FOR A FUSED SALT ELECTROLYTIC CELL

[75] Inventor: Werner K. Fischer, Venthône, Switzerland

[73] Assignee: Swiss Aluminium Ltd., Chippis, Switzerland

[21] Appl. No.: 376,413

[22] Filed: May 10, 1982

[30] Foreign Application Priority Data

May 20, 1981 [CH] Switzerland ..... 3288/81

[51] Int. Cl.[3] ..... C25C 3/22

[52] U.S. Cl. ..... 204/247; 204/288; 204/279

[58] Field of Search ..... 204/247, 243 R–246, 204/67, 279, 288, 289, 297 R

[56] References Cited

U.S. PATENT DOCUMENTS

| | | | |
|---|---|---|---|
| 4,043,892 | 8/1977 | Gonzalez et al. | 204/247 |
| 4,136,003 | 1/1979 | Arnason et al. | 204/247 |
| 4,202,753 | 5/1980 | Bradford et al. | 204/247 |
| 4,218,300 | 8/1980 | Sturm | 204/247 |

*Primary Examiner*—Donald R. Valentine

*Attorney, Agent, or Firm*—Bachman and LaPointe

[57] ABSTRACT

A system for hooding an electrolytic cell used in the production of aluminum comprises a plurality of aluminum hoods supported on the anode rods of the cell. The anode rods are provided with a plurality of cams projecting out of the sides thereof parallel to the anode pins for supporting the hoods. The hoods are provided with a cut-out opening for receiving the anode rod.

15 Claims, 3 Drawing Figures

ANODE HOODING SYSTEM FOR A FUSED SALT ELECTROLYTIC CELL

BACKGROUND OF THE INVENTION

The present invention relates to an anode for a hooded, fused salt electrolytic cell for producing aluminum, said anode having an anode rod and at least one carbon block attached to an anode rod pin.

In the production of aluminum by the fused salt electrolysis of aluminum oxide, the aluminumoxide is dissolved in a fluoride melt made up for the most part of cryolite. The cathodically precipitated aluminum collects under the fluoride melt on the carbon floor of the cell, the surface of the liquid aluminum itself forming the cathode. Dipping into the melt from above are anodes which in conventional processes are made of amorphous carbon. At these carbon anodes oxygen forms as a result of the electrolytic decomposition of the aluminum oxide. The oxygen reacts with the carbon of the anodes to form $CO_2$ and CO. The electrolytic process takes place in a temperature range of around 940°-970° C.

During the course of the electrolytic process the electrolyte becomes depleted of aluminum oxide. At a lower aluminum oxide concentration of 1-2% in the electrolyte the anode effect occurs whereby the voltage rises from 4-5 V to 30 V and more. At this time the concentration of aluminum oxide must be raised by the addition of alumina to the cell.

The present day environmental requirements require the waste gases produced during the manufacture of aluminum to be collected and passed through a suitable waste gas treatment unit before release to the atmosphere.

Numerous systems for covering the cell on all sides have been proposed in order to meet these requirements. The waste gases are led off via a pipe running the length of the cell along its central axis.

Known hooding systems are made up essentially of covers positioned horizontally below the anode beam around the anode rods (DE-OS 2 330 557) or the anode blocks (DE-OS 2 251 898) with other side covers attached at the sides and sloping down to the edge of the cell. The sloping covering at the side is subdivided into a series of hoods. When attending to the cell one or more hoods or even the whole sloping side covering can be raised by means of a supporting frame.

According to a further version described in DE-OS 2 510 400 the hooding is attached to the anode beam itself and can be tilted up by a two-stage tilting movement around an axis of rotation laying in the longitudinal direction of the cell.

Finally, according to the published pat. appl. DE-OS 2 263 348 the parts of the hooding forming the covers at the longitudinal side of the cell can be pushed inside one another.

In spite of their relatively expensive construction, these known hooding systems suffer from a number short-comings. In particular, in DE-OS 2 263 348, when changing anodes, either an extensive part of the cell must be uncovered or else the anodes cannot be readily changed. Furthermore, raising the anode beam, for which an auxiliary traverse is usually employed, is not always possible without some difficulty.

A further disadvantage of these known hooding systems lies in the economics of these systems. The financial outlay is relatively large and retrofitting non-hooded cells, if at all possible, involves very great expense.

In U.S. Pat. No. 4,218,300 a more economical hooding is disclosed which is also more suitable for attending to the cell. The hooding comprises very light, throw-away hoods which can slide both on the anode beam and on the edge of the cell.

Stops limiting the raising movement ensure that in the upper range of the raising movement the lightweight hoods slide on the edge of the cell, in the lower range on the other hand only on its vertical part.

A disadvantage which has to be accepted, however, with such lightweight hoods is that they are often bent or otherwise deformed and therefore no longer air-tight. To maintain a properly functioning covering for the cell a considerable amount of checking of these parts is therefore necessary. One must decide whether and when the defective hoods have to be replaced.

It is therefore the principal object of the present invention to develop a hooding system for electrolytic cells employing throwaway hoods which are easy to change and do not require any special work of inspection.

SUMMARY OF THE INVENTION

The foregoing object is achieved by way of the present invention wherein two cams or bolt ends positioned at the same level above the anode pin/pins and projecting out of the sides of the anode rod lying parallel to the longitudinal sides of the anode pin/pins, and a rectangular throw-away aluminum or aluminum alloy hood, which is hung onto the anode rod before putting the anode into the cell, has in its upper region an opening able to accommodate the anode rod with some play, and rests on the cams or bolt ends, the said hood being broader than the carbon block/blocks suspended from the anode rod and projecting over the carbon block/blocks to rest its lower curved end on the horizontal edge of the cell on which it can slide.

The minimum resting surface provided by the cams or bolt ends is chosen in accordance with the amount of play between the hood and the anode rod. It must be at least 5 cm, is however generally of the order of 10-20 cm. This ensures optimum support for the hood.

In order for the hood to exhibit the absolute minimum mechanical strength, it must weigh 1-2 kg. The strength can be increased by giving it a spherical curvature similar to the shape of the boot lid of a car. A mechanism for increasing the strength is to provide corrugations and/or flanging - which results in an increase in weight which is a disadvantage.

The throwaway hood can be fitted to the anode rod using the opening provided therein. This somewhat awkward manipulation can be omitted if the residual strip at the opening is cut in the middle and one part bent upwards and the other part downwards until the distance between the resultant flanges is at least equal to the breadth of the anode rod. The hood can then be pushed on or pulled away by turning it about its longitudinal axis and then turning it back again into the original position. The flanges prevent the hood sliding out of place when mounted on the anode rod on the cell.

Taking this manipulation into account one must ensure that the play between the hood and the anode rod is not too small. On the other hand too much play would mean that the hooding would not be adequately air tight and the hoods less well centered.

The following modes of sealing are preferred, either alone or in combination:

(1) Edge seals are pushed onto the edges of the opening for the anode rod in the hood. The hood can move with respect to the anode rod without both being brought to the same electrical potential.

(2) The surface of the hood sliding on the edge of the cell is coated with an insulating material, for example by spraying on tetrafluorethylene (Teflon).

(3) The edge of the cell is made of an insulating material or is coated with such a material.

(4) The hood is, with respect to its longitudinal direction, made up of two parts with both metallic parts being joined securely with an electrically insulating material.

Usefully, the throwaway hood is hung onto the anode rod along with the fitting of the carbon block or the blocks of double anodes which are attached to a common anode rod. This fitted hood rests at the top on the cams or bolt ends and at the bottom on the carbon blocks.

Before putting the anodes into service in the cell, a horizontal support on which the hood rests is constructed over the whole length of the anode beam. A sliding surface must be provided at the edge of the cell for the lower, curved end of the hood. If the anode in the cell is lowered in the course of the production process, then this ensures that the hoods lying side-by-side provide a uniform covering for the cell:

In the case of anodes which can be lowered individually only the projecting cams are lowered with the anode rod; the hoods resting on the angle section extending the whole length of the anode beam remain in the same position.

If the anode beam is lowered, and with that all the anodes at the same time, then all hoods move downwards and simultaneously slide outwards on the edge of the cell.

All the hoods on the anodes thus produce a closed cell covering. It is sufficient for the hoods to rest next to each other without overlapping. It is not desirable for the hooding to be too air-tight as this would produce a negative pressure in the cell and an attendant loss of alumina.

The covering of the ends of the cell is as normal that is with stationary panels. Usefully, the electrolytic cells are so conceived that the tapping of the metal can be made at the ends of the cell.

The changing of spent anodes is also as normal that is the anode is raised, at the same time automatically lifting away the throwaway hood.

The advantages of the covering system according to the present invention can be summarized as follows:

(a) The pressure conditions in the cell are always under control.

(b) The throwaway hoods weight only 1–2 kg.

(c) The hoods are removed automatically on changing anodes and can be replaced in the anode crushing plant.

(d) If there is premature, accidental damage to any of the hoods, it can be easily changed individually and thrown into the cell.

BRIEF DESCRIPTION OF THE DRAWINGS

The present invention will be described in greater detail with reference to the drawings wherein.

DETAILED DESCRIPTION

Figure 1:
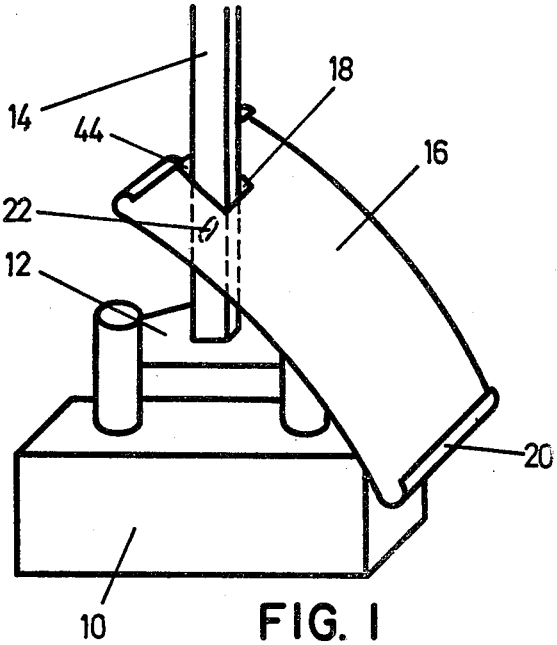
FIG. 1 is a perspective view of an anode ready for use.

The ready-to-use anode shown in FIG. 1 comprises a block-shaped carbon body 10 which is suspended from an anode rod 14 via anode pin 12. A plurality of carbon blocks can be suspended from the same anode rod as is known in the art, for example a double anode arrangement with two carbon blocks on the anode rod. In the upper part of the throwaway hood 16 is an opening 18 which can accommodate the anode rod 14 with a play of about 1 cm. The end 20 of the hood 16 is curved and the sliding surface on the outside is electrically insulated. Two bolt ends 22 prevent the hood from slipping down the anode rod.

Figure 2:
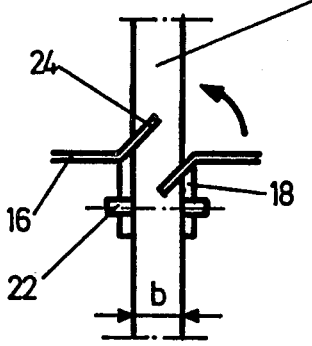
FIG. 2 is a view of the mechanism for hanging on the hood in FIG. 1 from the left hand side.

In the embodiment shown in FIG. 2, the opening 18 is provided in the middle at the back (left in FIG. 1) and the ends 44 bent 45° in opposite directions until the distance is equal at least to the breadth b of the anode rod. To remove the hoods individually they can be easily raised and then turned in the direction of the arrow until both flanges 24 lie parallel to the anode rod 14 of breadth b. The hood can then be readily pulled out in this position. On fitting a new hood, this is pushed onto the anode rod 14 with the flanges 24 parallel to the rod, then rotated in the opposite direction to the arrow into the working position.

Figure 3:
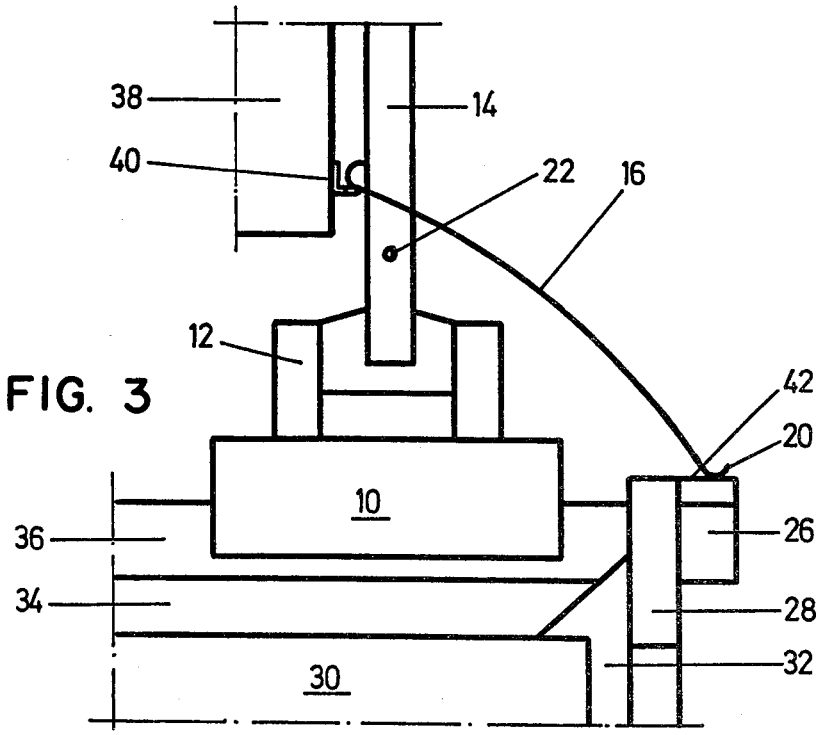
FIG. 3 is a partial, sectioned end view of an aluminum fused salt electrolytic cell with anode in place.

The anode shown in FIG. 3 is in the working position in an aluminum fused salt electrolytic cell which in the lower part comprises the supporting section 26 for the steel tank, the carbon side wall 28, the carbon floor 30 and the compacted mass 32 at the side of the cell. Lying on the carbon floor 30 of the cell are the precipitated liquid metal 34 and the electrolyte 36.

Attached to the anode beam 38 is an angle section 40 on which the upper part of the throwaway hood 16 rests. The lower part of the hood with the curved end 20 can slide on the horizontal, electrically insulated edge 42 of the cell when the height of the beam is changed.

In the present example the anode rods 14 can be lowered individually. As the anode is lowered, the bolt ends move away from the hood 16 which rests on the angle section 40. On changing the anodes the bolt ends 22 move upwards, engage the hood 16 and lift it away from the cell.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for hooding an electrolytic cell used in the production of aluminum having at least one anode rod for supporting at least one anode comprising at least two cams projecting from opposite sides of said anode rod in directions substantially parallel to the floor of said cell and a rectangular aluminum hood having a cut-out opening in its upper region for receiving said anode rod with some play wherein said hood rests on said cams.

2. A hooding system according to claim 1 wherein said hood is broader than said anode.

3. A hooding system according to claim 2 wherein the lower region of said hood is curved and rests on the horizontal edge of said cell on which it can slide.

4. A hooding system according to claim 1 wherein said cams project out from said anode rod at least 5 cm.

5. A hooding system according to claim 1 wherein said cams project out from said anode rod at least from 10 to 20 cm.

6. A hooding system according to claim 1 wherein said opening in the upper part of said hood provides a play of 1 to 2 cm between said anode rod and said hood at the sides of the opening.

7. A hooding system according to claim 1 wherein said hood is spherically curved.

8. A hooding system according to claim 1 wherein corrugations are provided in said hood.

9. A hooding system according to claim 1 wherein flanged over-edges are provided in said hood.

10. A hooding system according to claim 1 wherein a residual strip is provided behind the opening for the anode rod and is cut in the middle and the ends bent in opposite directions such that the distance between the resultant flanges is at least equal to the breadth of the anode rod.

11. A hooding system according to claim 10 wherein said flanges are bent in opposite directions at 45° with respect to the hood.

12. A hooding system according to claim 1 wherein the edges of the opening running parallel to the floor of said cell are provided with push-fit seals.

13. A hooding system according to claim 3 wherein said curved end of said hood is provided with an electrically insulating layer.

14. A hooding system according to claim 1 wherein said hood is separated along its length and joined again with a mechanically stable, electrically insulating joint.

15. A hooding system according to claim 1 wherein said hood is a throwaway item.

* * * * *